US005645216A

United States Patent [19]

Benenowski et al.

[11] Patent Number: 5,645,216

[45] Date of Patent: Jul. 8, 1997

[54] BEARING FOR A PART OF A RAILROAD TRACK

[75] Inventors: Sebastian Benenowski, Butzbach; Albrecht Demmig, Kirchmöser; Hans-Ulrich Dietze, Wusterwitz; Alfred Kais, Lich-Eberstadt; Erich Nuding, Aalen, all of Germany

[73] Assignee: BWG Butzbacher Weichenbau GmbH, Butzbach, Germany

[21] Appl. No.: 411,834

[22] PCT Filed: Sep. 30, 1993

[86] PCT No.: PCT/EP93/02658

§ 371 Date: Mar. 31, 1995

§ 102(e) Date: Mar. 31, 1995

[87] PCT Pub. No.: WO94/08093

PCT Pub. Date: Apr. 14, 1994

[30] Foreign Application Priority Data

Oct. 1, 1992 [DE] Germany ..... 42 32 990.6

[51] Int. Cl.[6] ..... E01B 9/62

[52] U.S. Cl. ..... 238/283; 267/152; 248/575; 248/606; 248/618

[58] Field of Search ..... 238/283, 287; 267/140.2, 140.3, 152, 153; 248/575, 576, 606, 618, 621, 635

[56] References Cited

FOREIGN PATENT DOCUMENTS

| | | |
|---|---|---|
| 229409 | 7/1987 | European Pat. Off. . |
| 956687 | 1/1957 | Germany . |
| 3033607 | 7/1982 | Germany . |
| 3403235 | 8/1985 | Germany . |

*Primary Examiner*—S. Joseph Morano
*Attorney, Agent, or Firm*—Dennison, Meserole, Pollack & Scheiner

[57] ABSTRACT

A bearing system for a part of a railroad track, such as a rail-fastening or ribbed slab (10), supported by elastic elements on, for example, a railroad sleeper. The elastic elements form a spring system with a kinked characteristic curve such that when the spring system is subjected to force that is smaller than the forces active in the operative range (16) of the spring system, the characteristic curve rises steeply and, in the operative range (16), runs flat.

21 Claims, 4 Drawing Sheets

BEARING FOR A PART OF A RAILROAD TRACK

SUBSTITUTE SPECIFICATION

The invention relates to a bearing for a part of a railroad track such as a rail-fastening plate or a ribbed slab for receiving a rail section, which section is traversed by rolling stock with a wheel load. The bearing is indirectly or directly connected to a support, where on the support side the track superstructure is supported on a first elastic element, and where on the rail side a prestressed device is disposed having at least one second elastic element for indirectly or directly prestressing the track superstructure in relation to the support, and where the first and second elastic elements each operate according to characteristic curves. The elastic elements forming a spring system with a combined characteristic curve being operative within the range of forces which are introduced by normal wheel loads.

A sound-insulating rail foundation comprising a base plate, a rail supporting plate and an element disposed between the base plate and the rail supporting plate is known from DE 30 33 607 C2.

To achieve an additional sound-damping effect, prestressing devices tensioning the rail supporting plate against the base plate are provided between the base plate and the rail supporting plate at a lateral distance from the first insulating elements, said devices comprising abutments held by threaded bolts, between which abutments and the base plate is disposed an elastically deformable prestressed element. Resultant inherent frequencies are to be altered with a suitable rail foundation such that undesirable noise developments are prevented.

The design of the insulating elements and their arrangement formed from these elements, results for the overall system having a spring characteristic curve that has a substantially constant steepness. This means that a linear relation exists between the spring displacement and the force introduced.

The proposed measures cannot always prevent the vibrations caused by rolling stock from being transmitted to the sleepers and to the ballast in such a way that the latter can start to yield, in particular when corresponding rail foundations are used in high-speed tracks.

Further, depending on the spring characteristic curves of the insulating elements used, the entire track superstructure becomes either always uniformly "hard" or uniformly "soft". The latter is particularly disadvantageous when construction work is necessary on the track superstructure or the support structure.

The problem underlying the present invention is to develop a bearing of the type described at the outset such that optimum conditions with regard to elasticity are obtained as a function of the forces introduced, i.e. such that when aligning and tamping a track, for example, the track superstructure practically forms a rigid unit, whereas during the passage of rolling stock there is an elasticity that permits effective damping.

The problem is substantially solved in accordance with the invention in that the characteristic curve of the spring system has a kink or breakpoint such that when a force is introduced into the spring system that is less than the forces acting in the operative range, the characteristic curve rises steeply, whereas the characteristic curve is flat in the operative range.

A spring system is proposed in accordance with the invention that is hard under a low load and dynamically soft in a selectable range such as the operative range. The former means that the track superstructure is a rigid unit when work such as aligning or tamping of the tracks is necessary.

When the track is traversed, in particular by high-speed trains; however, the flat, plateau-like part of the characteristic curve results in heavy damping of the vibrations, so that undesirable transmissions of vibration to the substructure are in their turn avoided.

In this way, for example, the overall characteristic curve of the spring system in accordance with the invention can be designed such that the overall spring displacement in the case of an introduced force of between 0 to 50 kN is less than 0.5 mm, with a linear relation applying between the force and the spring displacement in this steep part of the characteristic curve.

In the subsequent range of force between 50 kN and 100 kN, the characteristic curve shows a flat course, which provides the required damping. In this flat range too, a linear relation between the force and the spring displacement should largely apply. The spring displacement covered can therefore be 2.5 mm in the case of a change in the introduced force changing from 50 kN to 100 kN.

The overall characteristic curve in accordance with the invention accordingly shows in the operative range, i.e., in the range in which normal wheel loads are introduced, a low spring stiffness, and can therefore damp intensively, whereas in front of the operative range a statically hard system applies.

This so-called kinked overall characteristic curve is a result in particular of the fact that a prestressed device receives the second spring element in such a way that the latter is compressed on all sides by a force, in particular by a force that is lower than the one in the operative range.

Within the operative range, i.e. absent the compression, the second spring element has a low spring stiffness which substantially determines the dynamically soft properties of the overall system.

The first spring element itself has a characteristic curve that is steeper in relation to the elastic range of the second spring element.

In other words, when the second, i.e. upper spring element when in the non-operative range of the overall system is to be regarded as tightened to a block, it is in the hard range and the spring property is absent. The second spring element; however, shifts directly into its elastic range when the overall system is in the operative range, since a stress relief takes place on account of the wheel load such that the second spring element is no longer compressed on all sides, and thus can exert its spring properties. The overall characteristic curve results from the substraction of the effective individual forces as a function of the respective force introduced and the resultant respective spring displacement.

The result of the above is that the overall characteristic curve is slightly steeper in its operative range than the characteristic curve of the first spring element.

Materials of the same kind can be used for the spring elements, such as rubber mixtures, polyurethane or other materials suitable for elastomer springs. To achieve the various characteristic curves, suitable shape designs must be used or suitable material hardnesses selected.

In accordance with a preferred embodiment, the second spring element can be designed as at least one projection facing away from the track superstructure and extending inside a receptacle of the prestressing device, the volume of this receptacle being identical to or slightly smaller than that of the projection.

This measure shows that whenever the prestressing device is tightened in the direction of the track superstructure support, the second spring element is completely held by the receptacle and is thus compressed on all sides. As a result, the second spring element loses its spring properties. The result is then the steep rise in the overall characteristic curve.

This ensures that the development of noise is prevented when the prestress is relieved due to a wheel load and that the receptacle can knock against the track superstructure when this wheel load is absent. A further proposal of the invention provides for the projection to extend from a plane-surface third spring element running parallel to the upper surface of the track superstructure and preferably along the latter. The second and third spring elements therefore form a unit as such, from which results a characteristic curve in which that section of the characteristic curve normally running parallel to the ordinate in the compression range of the second spring element is slightly inclined.

In particular, the second spring element can have several projections covered by a cover that contains receptacles allocated to these projections, said cover in turn being connected to the support by means of connectors and being tightenable in relation to the former in order to achieve the necessary prestressing.

If the track superstructure is a rail-fastening plate such as a ribbed slab, it can extend at least in some sections inside the first spring element in the form of an elastic intermediate layer. In this way, the first spring element can be vulcanized onto the rail-fastening plate.

The projections of the second spring element can be designed with a domed shape and can have the shape of a cylinder or truncated cone.

Further details, advantages and features of the invention are clear not only from the claims and from the features they describe, singly and/or in combination, but also from the following description of a preferred embodiment.

Figure 1:
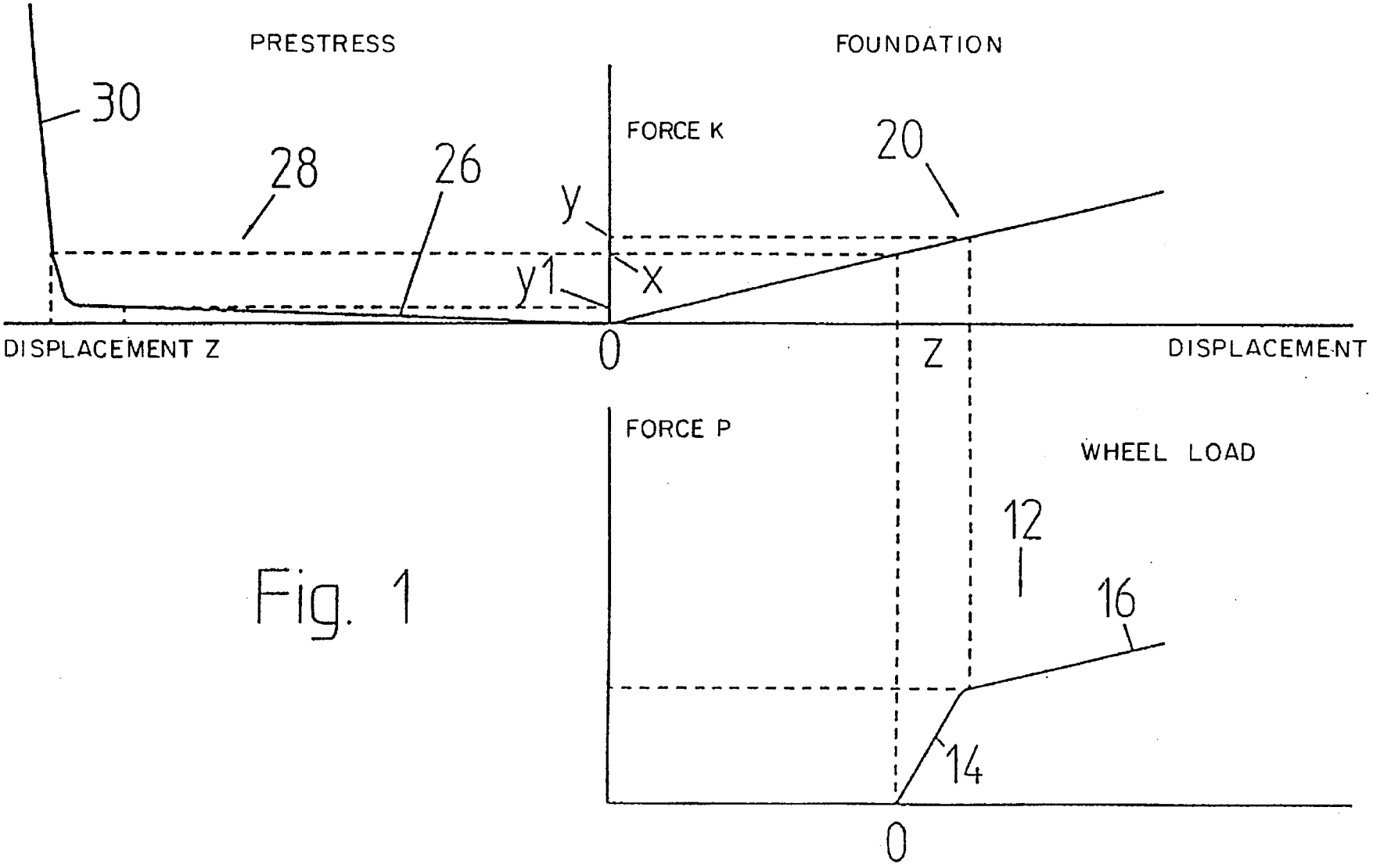
FIG. 1 shows a diagram of individual spring characteristic curves for formation of an overall characteristic curve.

In the figures, a bearing and its characteristic curve for a track superstructure in the form of a ribbed slab (10) are shown on which a rail not shown, can be attached in the conventional way.

The ribbed slab is supportable in relation to a support such as a sleeper, so that on the one hand a statically hard unit of the track superstructure is obtained in cases where the introduced forces are lower than usual wheel loads, and on the other hand a dynamically soft unit is obtained when normal wheel loads are applied. In order to sufficiently dampen vibrations, the ribbed slab (10) is held by a spring system and supported in relation to this support. To achieve a characteristic curve as shown below right in the force versus displacement diagram of FIG. 1 the spring system will now be described.

The desired characteristic curve numbered (12) has a steep rise (14) that merges into a plateau-like section (16) which rises flatly and corresponds to normal wheel loads in relation to the introduced forces P.

The steep rise (14), which is substantially linear in course, applies when forces up to 30 to 50 kN are introduced. The operative (16) extends from this value to above 100 kN. Above the operative range, the characteristic curve of the overall spring system is not of interest, thus it has not been illustrated.

In order to provide a support between the ribbed slab and the underlying support such as a sleeper, to obtain an appropriately kinked characteristic curve (12), in accordance with the invention, a first spring element in the form of an elastic intermediate layer or foundation (18) is provided. The intermediate layer (18) can be vulcanized into the ribbed slab (10) and cover the latter at least in some sections along the longitudinal edges.

The first spring element or the intermediate layer (18) has a characteristic curve shown at top right in FIG. 1 and is numbered (20). It can be seen that the intermediate layer or foundation (18) has a linear characteristic curve, i.e. the introduced force and the spring displacement are proportional.

Above the ribbed slab (10), a second spring element is provided that is composed in the preferred embodiment of two dome-like, i.e. truncated-cone-shaped, projections (22), (24).

The second spring elements (22) and (24) have a characteristic curve shown at top left in FIG. 1, as far as this is the flatly rising range (26) shown as a dashed line.

It is now provided in accordance with the invention that the second spring element (22) or (24) and hence the system enclosing the ribbed slab (10) and the foundation (18) be prestressed in relation to the sleeper such that an overall curve (28) comprising the flat section (26) and a steeply rising section (30) is obtained. The latter section (30) is achieved by prestressing the spring element (22) or (24) such that it is compressed on all sides. In this case, the spring element (22) can no longer have spring properties in the proper sense, with the result that the steep section (30) is obtained, which in the ideal case ought to be parallel to the ordinate (force P).

Figure 2:
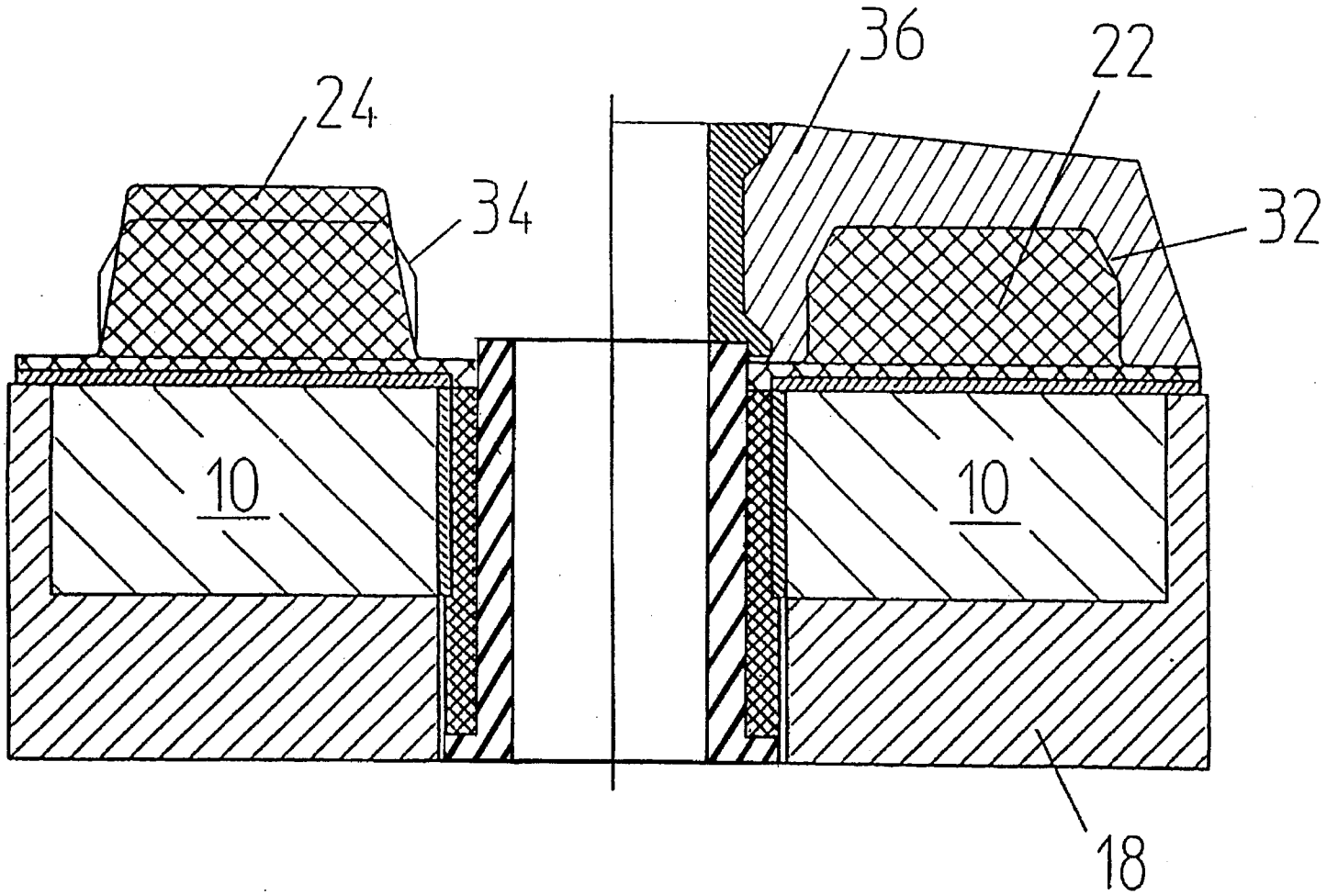
FIG. 2 shows a section through a ribbed slab held by a spring system.
Figure 3:
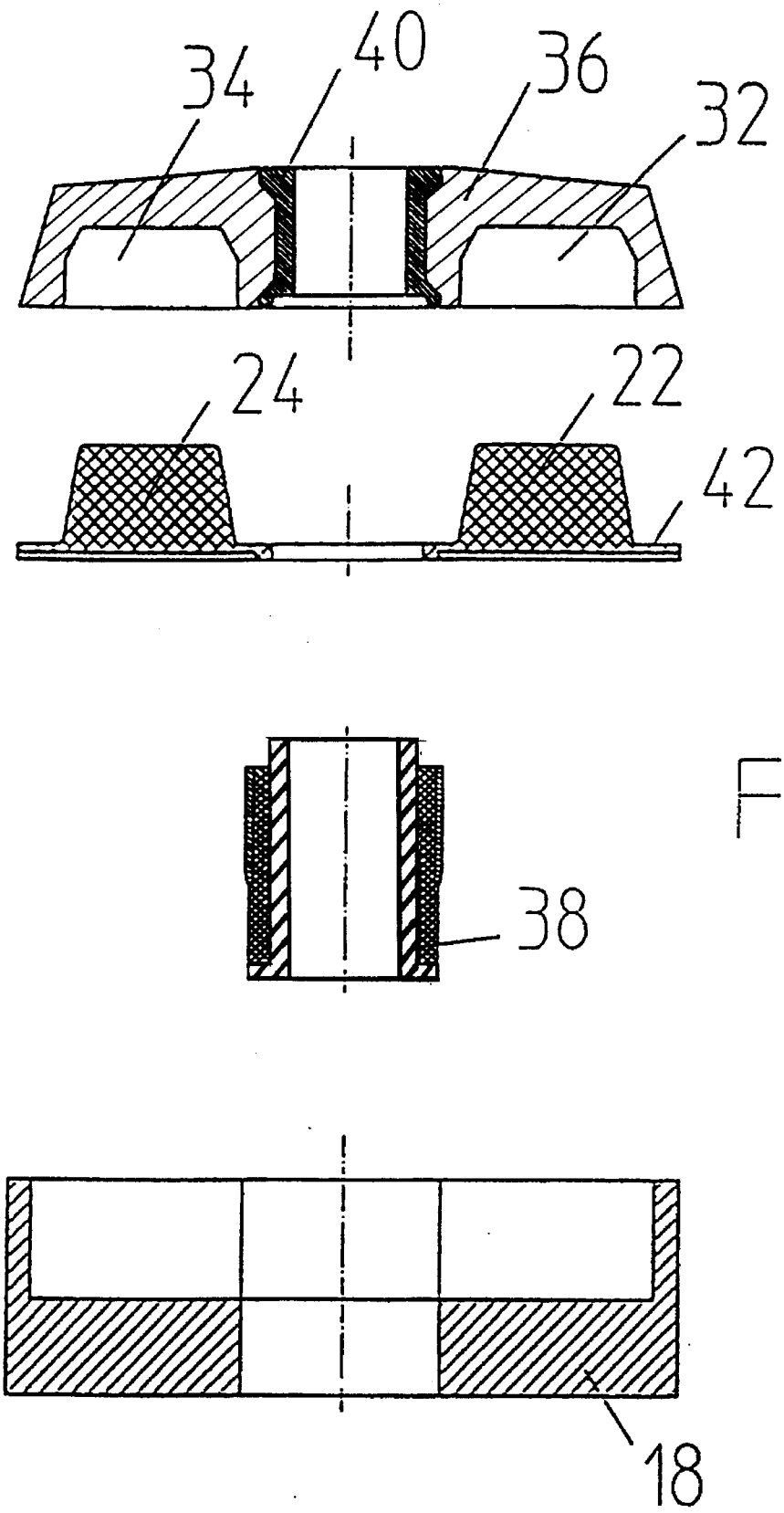
FIG. 3 shows an exploded view of the arrangement corresponding to the right-hand part of FIG. 2.

To achieve the compression range, the dome-like projections (22), (24) are covered by a clamping plate (36) having receptacles (32), (34), said plate being shown only partially in FIG. 2, on the right-hand side.

If the clamping plate (36) is tightened by a fastening element such as a bolt, not shown, in relation to the support and hence in the direction of the ribbed slab (10), the spring element (22) is so deformed that the receptacle or cavity (32) is completely filled, preventing any further compression. It is essential here that the volume of the receptacle (32), (34) is identical to or slightly smaller than that of the dome-like projections (22), (24).

This prestressing or preloading results in an overall spring system comprising the first spring element (18), i.e. the foundation, the second spring element (22), (24), i.e. the dome-like projections, and the system having the characteristic curve (12) in accordance with FIG. 1. Here the characteristic curve of the prestressed second spring elements (22) and (24) is selected such that the steeply rising range (14) of the overall characteristic curve is before the operative range proper in which the rail fastened on the ribbed slab is subjected to loads when traversed by the wheels.

The overall characteristic curve is achieved as follows:

In the initial state 0, the overall system is prestressed. The first and second springs (18) and (22) are acted on by a compression force x, which causes the spring displacement shown in FIG. 1 (dashed lines drawn parallel to the ordinate) of the individual spring elements (18) or (22) and (24).

If a force y now acts on the overall system, corresponding to a wheel load in the usual operative range, the first spring element or the foundation (18) is further compressed over a distance z. Pressure relief of the second spring elements (22) and (24) takes place to the same extent.

If the force $y_1$ acting on the prestressed spring elements (22), (24) is subtracted from the force y acting on the foundation, the corresponding paired values of spring displacement/force P for the overall characteristic curve (12) are obtained. The result is that the range (14) of the overall characteristic curve is within the range of the force introduced within which the second spring elements (22) and (24) are still or substantially still compressed, i.e. not in the elastic range in which the spring properties take effect, that is in the range (26) of the characteristic curve (28). The wheel load P acting on the overall system is lower than the force K acting on the foundation, by the same amount caused by prestressing, i.e. the compression force.

In the left-hand part of FIG. 2, the projection (24) is shown in the relieved state. At the same time, the receptacle (34) is shown in section, showing that the volumes of projection (24) and the receptacle (34) are matched to one another such that compression occurs on all sides, as a result of which the projection (24) no longer has spring properties, and is hence completely stiff.

To tighten the clamping plate, the foundation (18) and the ribbed slab (10) are passed through by a bushing (38) that can form a single unit with the foundation (18) and the ribbed slab (10).

The bushing (38) continues in a sleeve-like reinforced section (40) inside the clamping plate (36). The dimensions of the sleeve and the bushing (38) are matched to one another such that the clamping plate is tightened so as to provide the required characteristic curve (12), i.e. prestressing which does not lead to an introduced force that unacceptably impairs the effect of the overall spring system.

To prevent the clamping plate (36) from knocking when the aforementioned relief takes place during traverse by rolling stock, the clamping plate is supported on a plate (42) to be designated as a third spring element, said plate having a high spring stiffness. The third spring element (42) also has the effect that the section (30) of the characteristic curve (28) is not parallel to the ordinate, but inclined in relation to it.

Standard rubber mixtures, polyurethane or other material suitable for elastomer springs can be used as materials for the spring elements (18), (22), (24) and also (42). The materials of the first spring element (18) and of the second spring element (22), (24) can be identical, so that the required spring characteristic curve is determined solely by the shape or material hardness.

Figure 4:
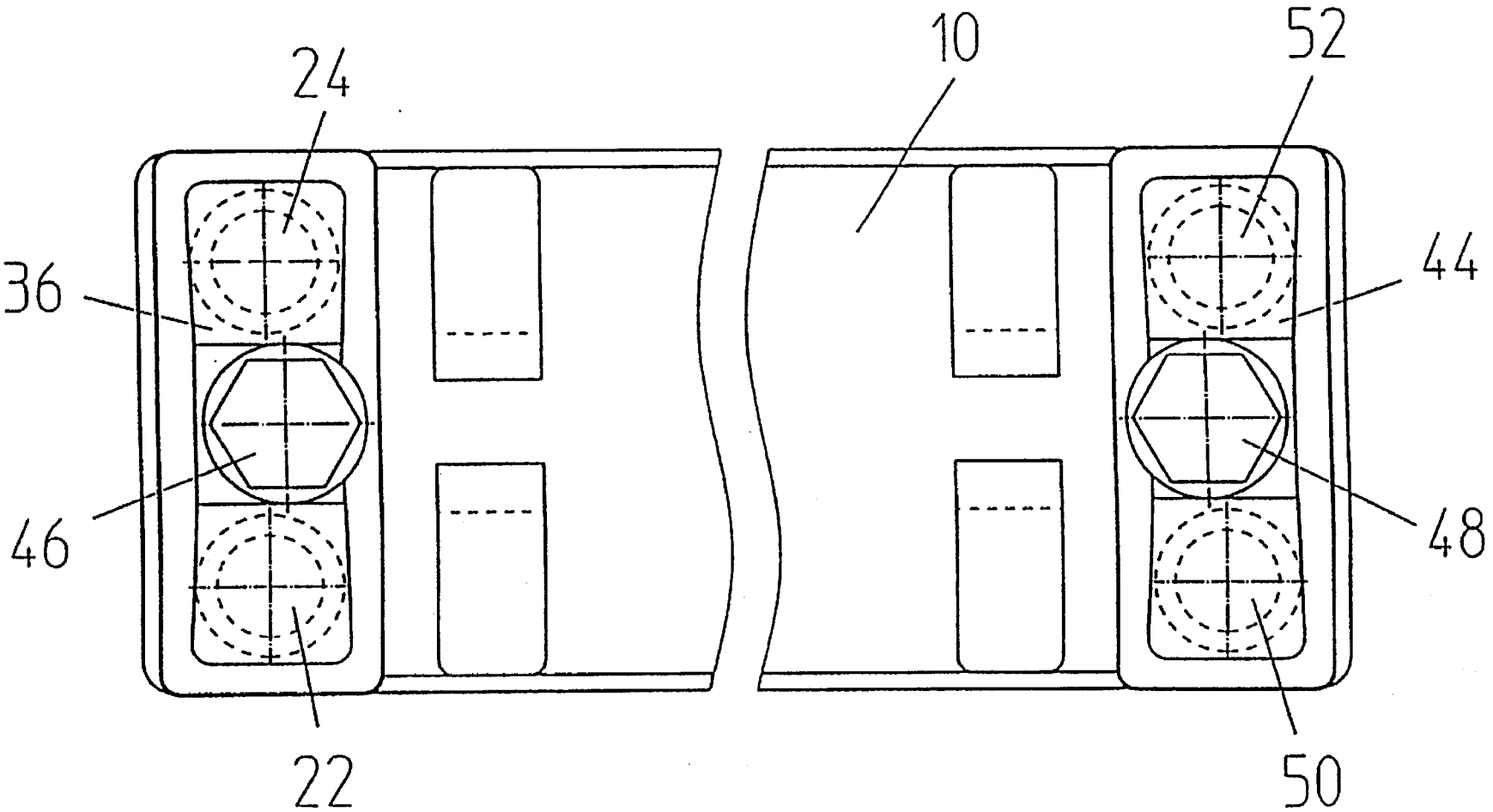
FIG. 4 shows a plan view of an arrangement corresponding to FIG. 2.

FIG. 4 shows once again in diagram form the ribbed slab (10) with the spring system in accordance with the invention and support for this ribbed slab in relation to the sleeper support can be seen in the respective edge areas. The clamping plates (36) and (44), are connected to the sleeper support by bolts (46) and (48) respectively and the bolts can be tightened in relation to the sleeper. The projections (22), (24), or (50), (52) are also shown as dashed lines, and are prestressed outside the operative range by the clamping plates (36) and (44) such that they are in their compression range, i.e. have the effect of a hard block.

We claim:

1. The bearing for a section of railroad track which is traversed by rolling stock with a wheel load, said bearing supporting a rail section and being connected to a sleeper support, said bearing including a rail-fastening plate (10), a first elastic element (18) supporting said rail-fastening plate, a prestressing device (36, 44, 46, 48) including at least one second elastic element (22, 24, 50, 52) for prestressing said railroad track section in relation to said sleeper support, wherein said first and said second elastic element are a first and a second spring, each spring exhibiting a characteristic curve (20, 28) describing a force versus displacement relationship, said first and said second spring forming a spring system with a combined characteristic curve (21) in an operative range (16) within the range of forces introduced by wheel loads, wherein said combined characteristic curve of said spring system exhibits a kink such that when a force is applied to said spring system that is less than the forces acting in said operative range (16), the characteristic curve rises steeply up to the kink, and the characteristic curve is substantially flat in said operative range after the kink.

2. The bearing according to claim 1, wherein said prestressing device receives the second elastic element (22, 24) in such a way that in order to suppress the spring properties of the second elastic element it is compressed on all sides by a force introduced into said spring system which is less than the force active in the operative range.

3. The bearing according to claim 1, wherein said second elastic element (22, 24) when not compressed is selected to have a lower stiffness than said first elastic element (18).

4. The bearing according to claim 1, wherein said second elastic element (22, 24) is designed so as to have at least one projection facing away from said rail fastening plate and extending inside a receptacle (32, 34) of said prestressing device (36), the volume of said receptacle being slightly smaller than the volume of said projection.

5. The bearing according to claim 4, wherein said projection is designed in the shape of a truncated cone.

6. The bearing according to claim 5, wherein said projection (22, 24) extends from a plate-surface third elastic element (42) which is located parallel to an upper surface of said rail fastening plate.

7. The bearing according to claim 1, wherein said rail-fastening plate is a ribbed slab.

8. The bearing according to claim 7, wherein said first spring element has sections and said rail fastening plate extends inside said sections, said first spring element is in the form of an elastic foundation.

9. The bearing according to claim 8, wherein said first spring element is vulcanized onto said rail fastening plate (10).

10. The bearing according to claim 1, further including a third elastic element, said prestressing device includes a clamping plate, and said third elastic element is formed as a flat plate upon which two springs having said second characteristic curve are supported, said two springs projecting from the flat plate and being covered by the clamping plate, the clamping plate being pressed relative to the sleeper support by bolts.

11. The bearing according to claim 10, wherein said third elastic element is made from material having a high stiffness spring characteristic.

12. The bearing system for a rail section forming part of a railroad track which can be subjected to wheel-load when traversed by rolling stock, comprising:

a rail fastening plate (10), a spring system including a first elastic spring element (18) supporting the rail fastening plate, a second elastic spring element (22, 24) mounted on top of said rail fastening plate, and clamping means (36, 46) for prestressing said spring system by compression, wherein said first elastic spring element exhibits a first characteristic curve (20), the second spring element exhibits a second characteristic curve (28), the combined characteristic curve resulting from the compression being in the form of a steeply rising section (14) in the absence of a force on the bearing system and a substantially flat section in an operative range (16), said operative range being defined by the pressure of wheel load forces caused by rail traversing rolling stock, and the curves describing a force versus displacement relationship.

13. The bearing system according to claim 12, wherein said combined characteristic curve exhibits a kink at the end of the steeply rising section and the beginning of the substantially flat section.

14. The bearing system according to claim 13, wherein said rail fastening plate is in the form of a ribbed slab.

15. The bearing system according to claim 13, wherein said first elastic spring element includes portions for embedding said rail fastening plate, said first spring element forming an elastic foundation for the system.

16. The bearing system according to claim 15, wherein said first elastic spring element is vulcanized onto said rail fastening plate.

17. The bearing system of claim 12, wherein the second elastic spring element is in the form of two domed projections facing away from the rail fastening plate, said clamping means includes a fastening device and a clamping device with two receptacles having a shape and volume slightly smaller than said domed projections.

18. The bearing system of claim 17 wherein said combined characteristic curve is obtained by the clamping means compressing said domed projections inside said receptacles on all sides so that the spring property of said second spring element is suppressed.

19. The bearing system of claim 17 wherein said fastening device is operated to apply a force upon the clamping device, said force being smaller than the force generated by the wheel load force of the rail traversing rolling stock.

20. The bearing system according to claim 17, wherein said domed projections are designed in the shape of truncated cones.

21. The bearing system according to claim 20, wherein said domed projections extend from a plane-surface third spring element (42) parallel to an upper surface of said rail fastening plate.

* * * * *